US006846231B2

(12) United States Patent
Oles et al.

(10) Patent No.: US 6,846,231 B2
(45) Date of Patent: Jan. 25, 2005

(54) REMOVABLE SHARPENING ATTACHMENT FOR A ROTARY HAND TOOL

(75) Inventors: Allen M. Oles, Chicago, IL (US); Edward T. Prell, Chicago, IL (US); Frank O. Honold, Libertyville, IL (US)

(73) Assignee: Credo Technology Corporation, Wilmington, DE (US)

( * ) Notice: Subject to any disclaimer, the term of this patent is extended or adjusted under 35 U.S.C. 154(b) by 132 days.

(21) Appl. No.: 10/062,031

(22) Filed: Feb. 1, 2002

(65) Prior Publication Data

US 2003/0148720 A1 Aug. 7, 2003

(51) Int. Cl.[7] ..... B24B 3/36

(52) U.S. Cl. ..... 451/415; 451/545; 451/457; 451/454

(58) Field of Search ..... 451/415, 438, 451/420, 419, 545, 454, 457, 358, 241

(56) References Cited

U.S. PATENT DOCUMENTS

| | | | | | |
|---|---|---|---|---|---|
| 1,664,896 | A | * | 4/1928 | Perdue | 451/438 |
| 1,961,328 | A | | 6/1934 | Beach | |
| 2,114,106 | A | | 4/1938 | Geveke | |
| 2,800,755 | A | * | 7/1957 | Perra | 451/415 |
| 2,921,416 | A | | 1/1960 | Shanahan | |
| 3,139,710 | A | * | 7/1964 | Ralston | 451/421 |
| 3,341,981 | A | * | 9/1967 | Baronyak | 451/415 |
| 3,812,626 | A | | 5/1974 | Thompson | |
| 4,615,144 | A | | 10/1986 | Peacock et al. | |
| 5,159,784 | A | | 11/1992 | Varner, Sr. et al. | |
| 5,251,407 | A | | 10/1993 | Afshar | |
| 5,676,591 | A | | 10/1997 | Huang | |
| 5,951,385 | A | | 9/1999 | New house et al. | |
| 6,106,372 | A | | 8/2000 | Clark | |
| 6,257,967 | B1 | * | 7/2001 | Schultz | 451/349 |

FOREIGN PATENT DOCUMENTS

| | | | | |
|---|---|---|---|---|
| SE | 0145909 | * | 6/1954 | 451/241 |

* cited by examiner

*Primary Examiner*—Robert A. Rose
(74) *Attorney, Agent, or Firm*—Greer, Burns & Crain, Ltd.

(57) ABSTRACT

A sharpening attachment for a powered rotary hand tool of the type which has an output shaft with a tool bit holder that extends from a housing is disclosed. The sharpening attachment is mounted on the housing and comprises a body portion with an interior opening through which a sharpening bit held by the tool bit holder can pass, with the sharpening bit being exposed for engaging a surface of a tool. The attachment has a jaw portion attached to the body portion which extends forwardly thereof and also has a support surface for holding the tool member at a predetermined angle relative to the sharpening bit, and an extension attached to the body portion and extending forwardly thereof at least to a point that includes a major portion of the exposed portion of the sharpening bit for the purpose of providing a protective guard.

24 Claims, 18 Drawing Sheets

REMOVABLE SHARPENING ATTACHMENT FOR A ROTARY HAND TOOL

BACKGROUND

The present invention relates generally to a removable sharpening attachment for use with a rotary hand tool. More particularly, the present invention relates to a removable sharpening attachment for a powered rotary hand tool that can be used to easily sharpen such items as gardening tools, metal blades and lawn mower blades.

Various types of sharpening devices are currently known, including grinding wheels and discs that can coupled to a hand drill or other rotary hand tool. However, most sharpening devices that are used to sharpen tools, such as gardening tools, metal blades, lawn mower blades and the like, are devices that have support surfaces or guides for grinding a surface or an edge of a blade or tool at a particular angle. Devices of this type are most commonly relatively stationary rather than portable, in that the blade or tool is usually brought to the device for sharpening rather than the device being carried to the blade or tool where it is sharpened.

SUMMARY OF THE INVENTION

The present invention is a sharpening attachment for a powered rotary hand tool of the type which has an output shaft with a tool bit holder that extends from a housing. The sharpening attachment is mounted on the housing and comprises a body portion with an interior opening through which a sharpening bit held by the tool bit holder can pass, with the sharpening bit being exposed for engaging a surface of a tool or blade. The attachment has a jaw portion attached to the body portion which extends forwardly thereof and also has a support surface for holding the tool member at a predetermined angle relative to the sharpening bit, and an extension attached to the body portion and extending forwardly thereof at least to a point that includes a major portion of the exposed portion of the sharpening bit for the purpose of providing a protective guard.

The invention has various embodiments, and in each of its embodiments, the support surface lies in a plane that is at an acute angle relative to the axis of the sharpening bit and positioned so that the plane intersects the outer circumference of a cylindrical sharpening bit. In some embodiments of the invention, the extension is opposite the jaw portion and extends beyond the end of the sharpening bit to provide a protective guard. In other embodiments, the extension has a transverse end portion which has a gap guide surface for contacting the tool member on the side opposite that which the jaw portion support surface contacts.

In all of its embodiments, a sharpening attachment is provided which enables a user to sharpen the cutting edge of lawn mower blades, garden tools and the like in an easy and efficient manner, with the support surfaces presenting the member being sharpened at a desired angle so that the angle of the cutting edge is consistently ground along its length. The clean, compact design also greatly contributes to its efficient and easy use.

DETAILED DESCRIPTION OF THE EMBODIMENTS OF THE INVENTION

The sharpening attachment of the present invention can be used with a rotary tool of the type which utilizes a motor to rotate an output shaft having a collet holding a sharpening bit such as a grinding stone held for engaging a work surface of a tool. The hand tool may be a rotary hand tool such as those marketed under the Dremel brand made by the S-B Power Tool Company of Chicago, Ill. The tool may also be an electric drill or other rotary tool, provided that the tool has a stationary mounting portion adjacent the collet so that the apparatus can be attached to the tool.

It should also be understood that while each of the embodiments illustrated and described herein are mounted to the nose portion of a rotary hand tool using cooperative threaded portions on the attachment as well as on the nose portion of the rotary tool, it should be understood that other mechanisms for mounting the attachment to the rotary hand tool may be utilized, including such mechanisms as a bayonet-type attachment or press-fit cooperative mating surfaces.

Figure 1:
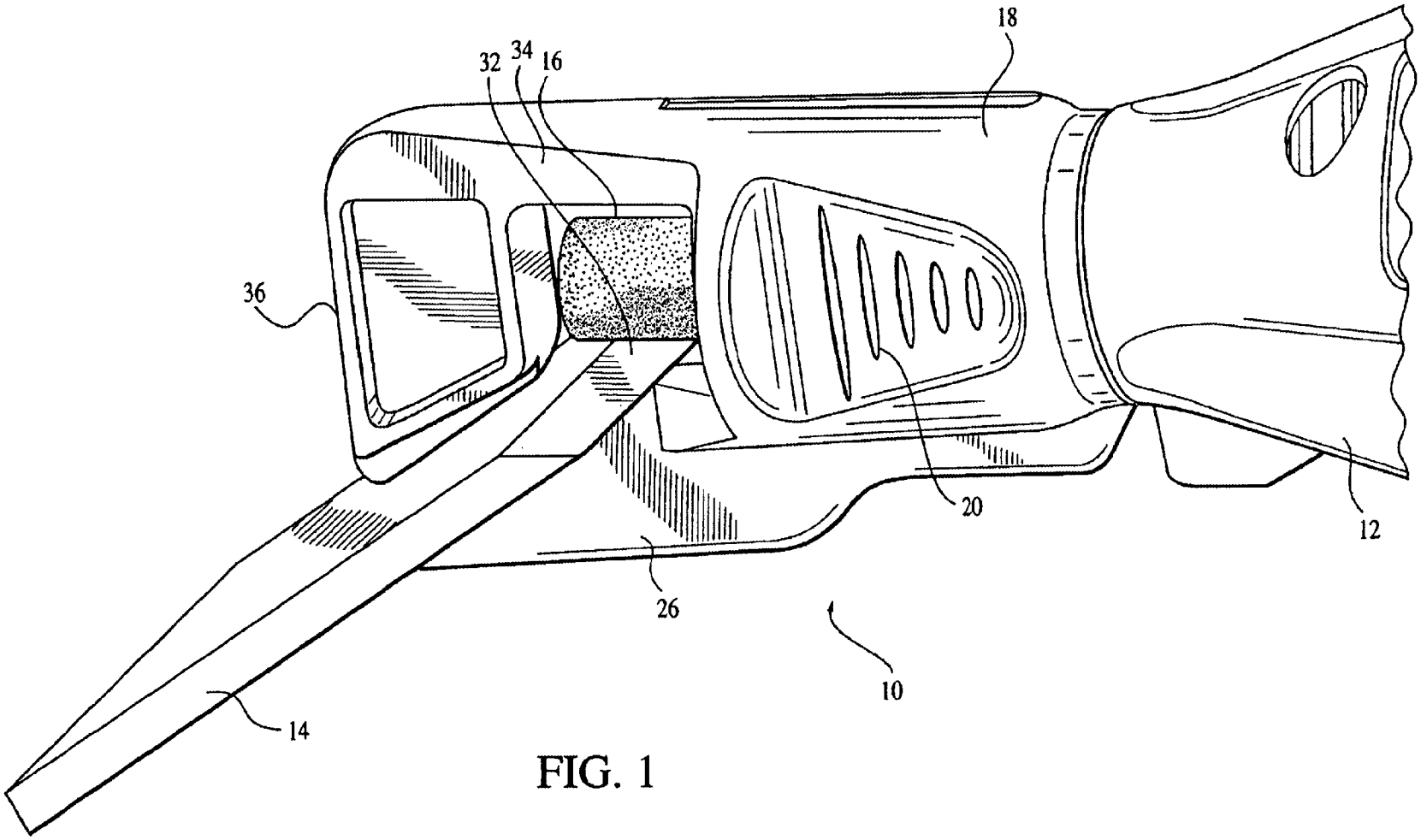
FIG. 1 is a perspective view from the side thereof of a first embodiment of the present invention shown mounted to a rotary hand tool and which also has a blade positioned within the attachment to be ground by a cylindrical grinding stone that is driven by the tool bit holder.
Figure 6:
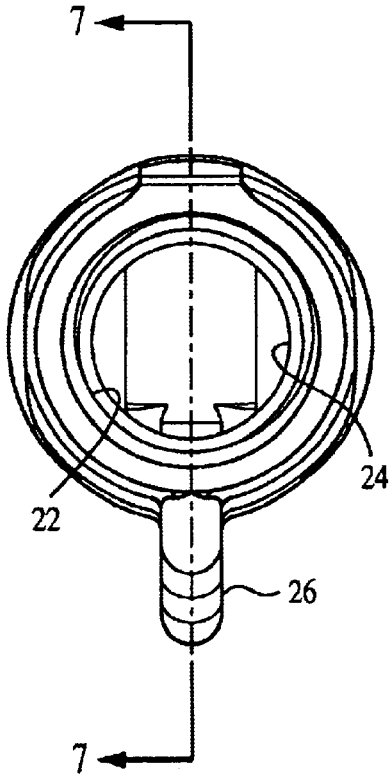
FIG. 6 is a right end view of the embodiment shown in FIG. 1.
Figure 7:
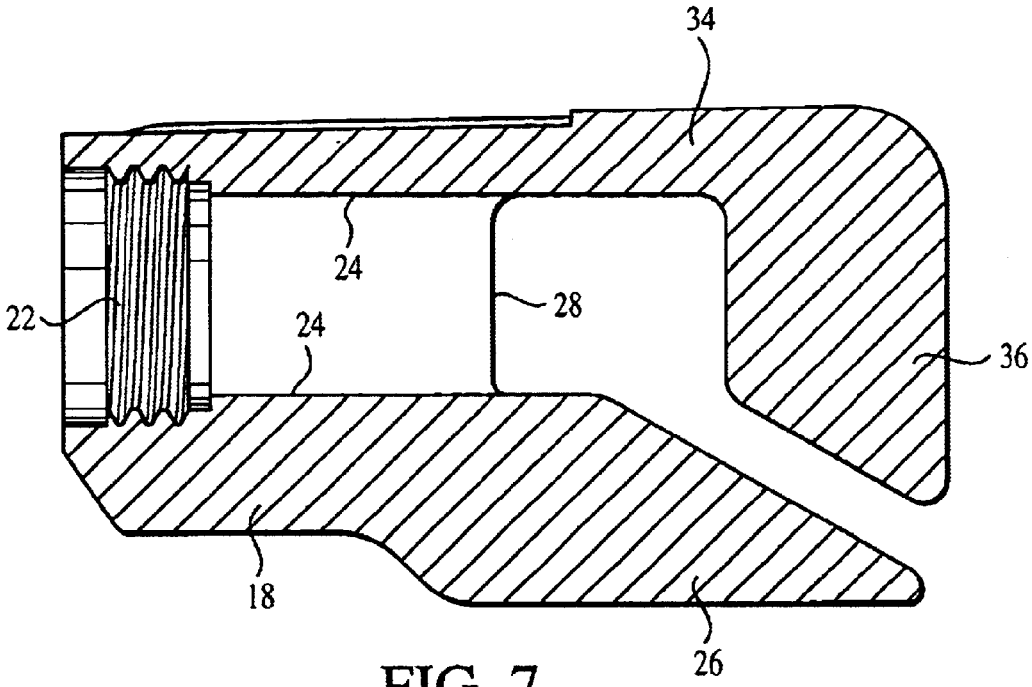
FIG. 7 is a cross-section taken generally along the line 7—7 of FIG. 6.
Figure 8:
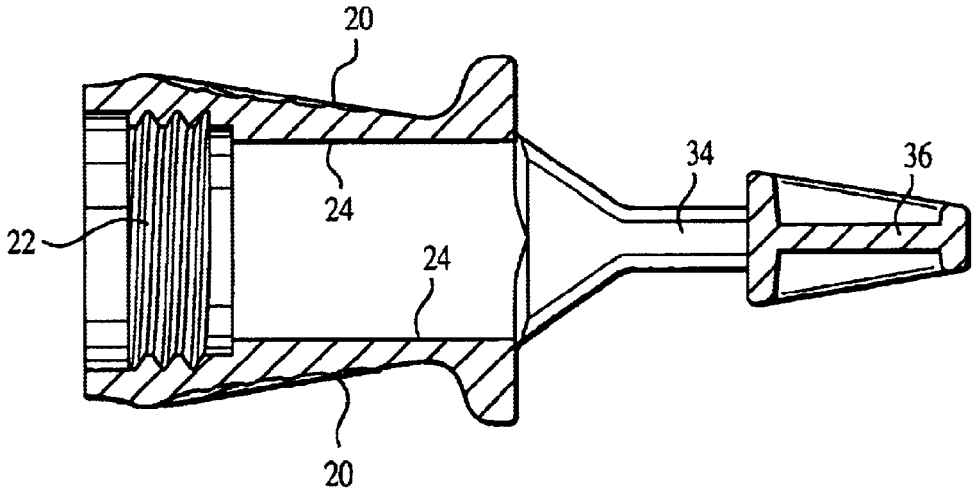
FIG. 8 is a cross-section taken generally along the line 8—8 of FIG. 5.

Turning now to the drawings, a first embodiment of the present invention is shown in FIGS. 1–8, with FIG. 1 particularly illustrating an attachment, indicated generally at 10, being mounted on the nose portion 12 of a powered rotary tool 12. The attachment 10 has a blade 14 in position to be sharpened by a generally cylindrical shaped grinding or sharpening bit 16 that is mounted to the rotary hand tool by a collet (not shown) that is mounted to an output shaft (not shown) of the rotary hand tool. The collet and output shaft are conventional and well known and the sharpening bit 16 also typically has a metal shaft that fits within the collet of the rotary hand tool. The attachment 10 has a body portion 18 that is generally cylindrical but which has a pair of recessed flat portions 20 on opposite sides of the body portion 18. As shown in FIG. 6, the right end of the body portion 18 has internal threads 22 which engage external threads of the nose portion 12 (not shown), and the interior of the body portion 18 has an internal diameter 24 that is larger than the outside diameter of the grinding bit 16. This is important in that it enables the attachment to be screwed on and off of the rotary tool with the grinding bit 16 being attached. It should be understood that the shaft of the grinding bit 16 together with the length of the grinding portion of the bit should be dimensioned so that it is exposed beyond the end of the body portion 18 as shown in FIG. 1.

The attachment 10 has a jaw portion 26 that extends forwardly of the end (defined by the flat surface 28) of the body portion 18 and the jaw portion has a support surface 30. The angle of the support surface 30 is preferably predetermined and can be within the range of about 15° to about 45° relative to the axis of the sharpening bit 16. The particular embodiment shown in FIGS. 1–8 has a support surface that is at an acute angle of approximately 30° relative to the axis of the bit 16 which is horizontal in the drawing of FIG. 2, for example. The relationship between the surface 30 and the blade member 14 that is being sharpened by the grinding bit 16 is particularly well illustrated in FIG. 1. It is also important that the edge 32 of the blade 14 be in contact with the outer surface of the sharpening bit 16, and in that regard, the plane of the support surface 30 intersects the outer surface of the grinding bit 16 as shown in phantom in FIG. 2, so that the entire thickness of the blade will be sharpened by the bit 16.

Figure 2:
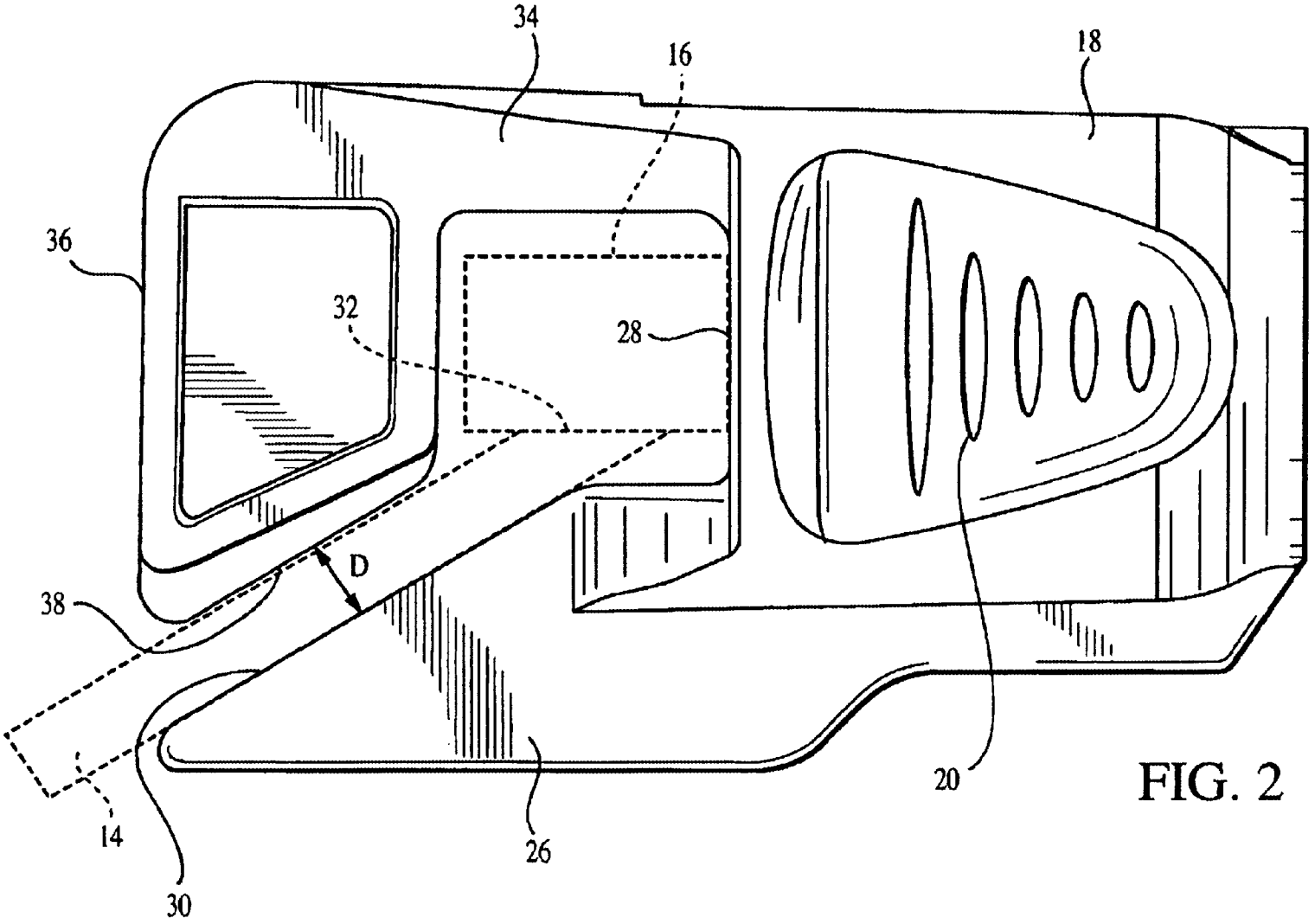
FIG. 2 is a side elevation of the embodiment shown in FIG. 1.
Figure 3:
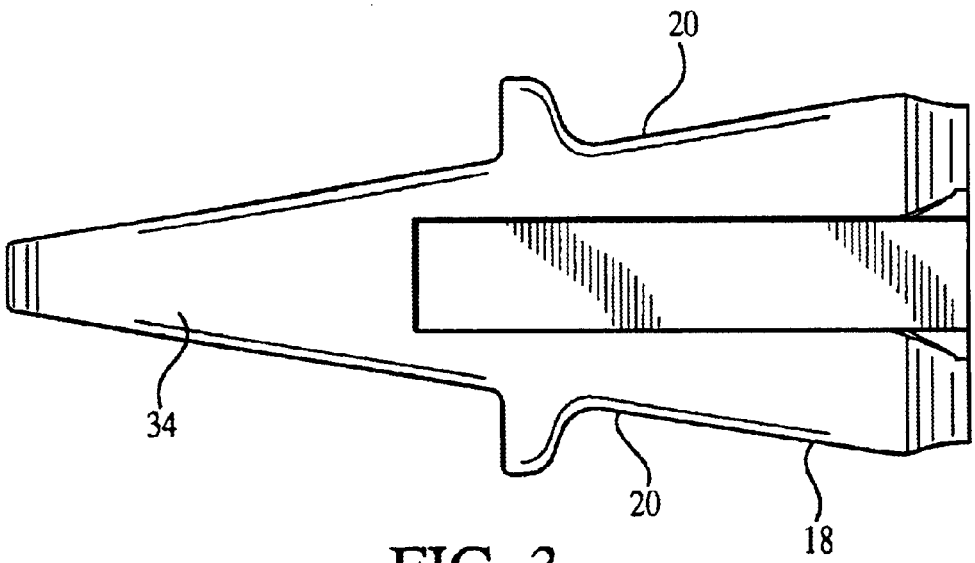
FIG. 3 is a top view of the embodiment shown in FIG. 1.
Figure 4:
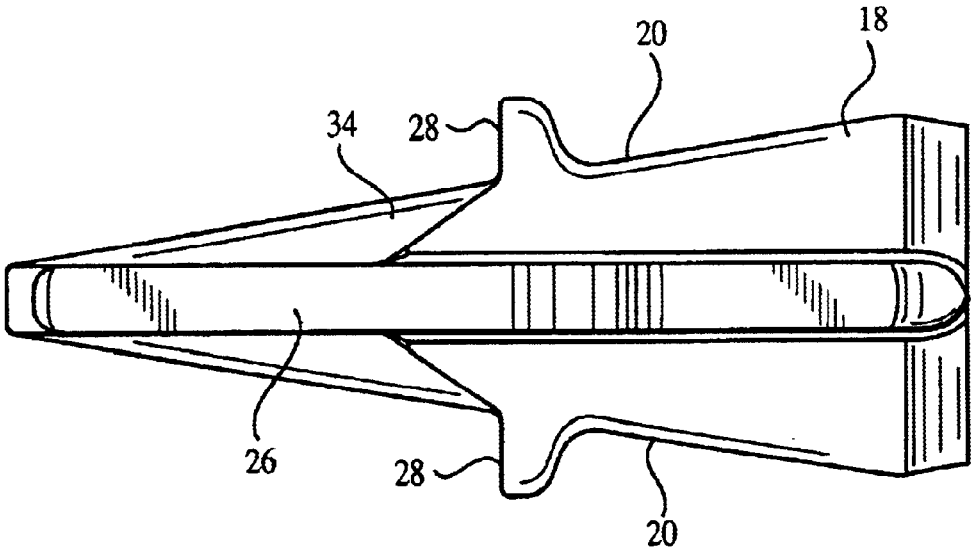
FIG. 4 is a bottom view of the embodiment shown in FIG. 1.
Figure 5:
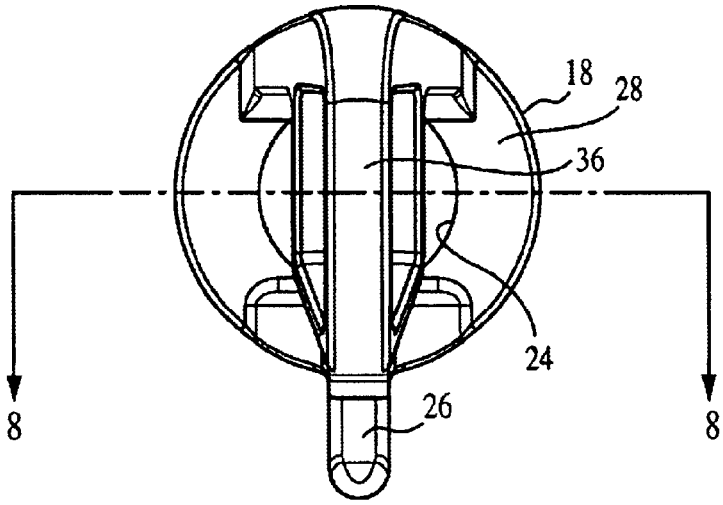
FIG. 5 is a left end view of the embodiment shown in FIG. 1.

The attachment 10 also includes an extension 34 that is attached to the body portion 18 and extends forwardly along the top thereof. In this first embodiment, the extension 34 extends well beyond the end of the sharpening bit 16 and has a transverse end portion 36 that extends radially inwardly toward the bit 16 and beyond it to the other side thereof and terminates in a gap guide surface 38. As best shown in FIG. 2, the gap guide surface 38 also lies in a plane which extends to the circumference of the grinding bit 16 and is substantially parallel to the plane in which the support surface 30 lies. Since the distance D between the surfaces 30 and 38 define a gap of predetermined distance, it represents the maximum thickness of a blade or tool that can be sharpened by the first embodiment of the present invention.

Figure 9:
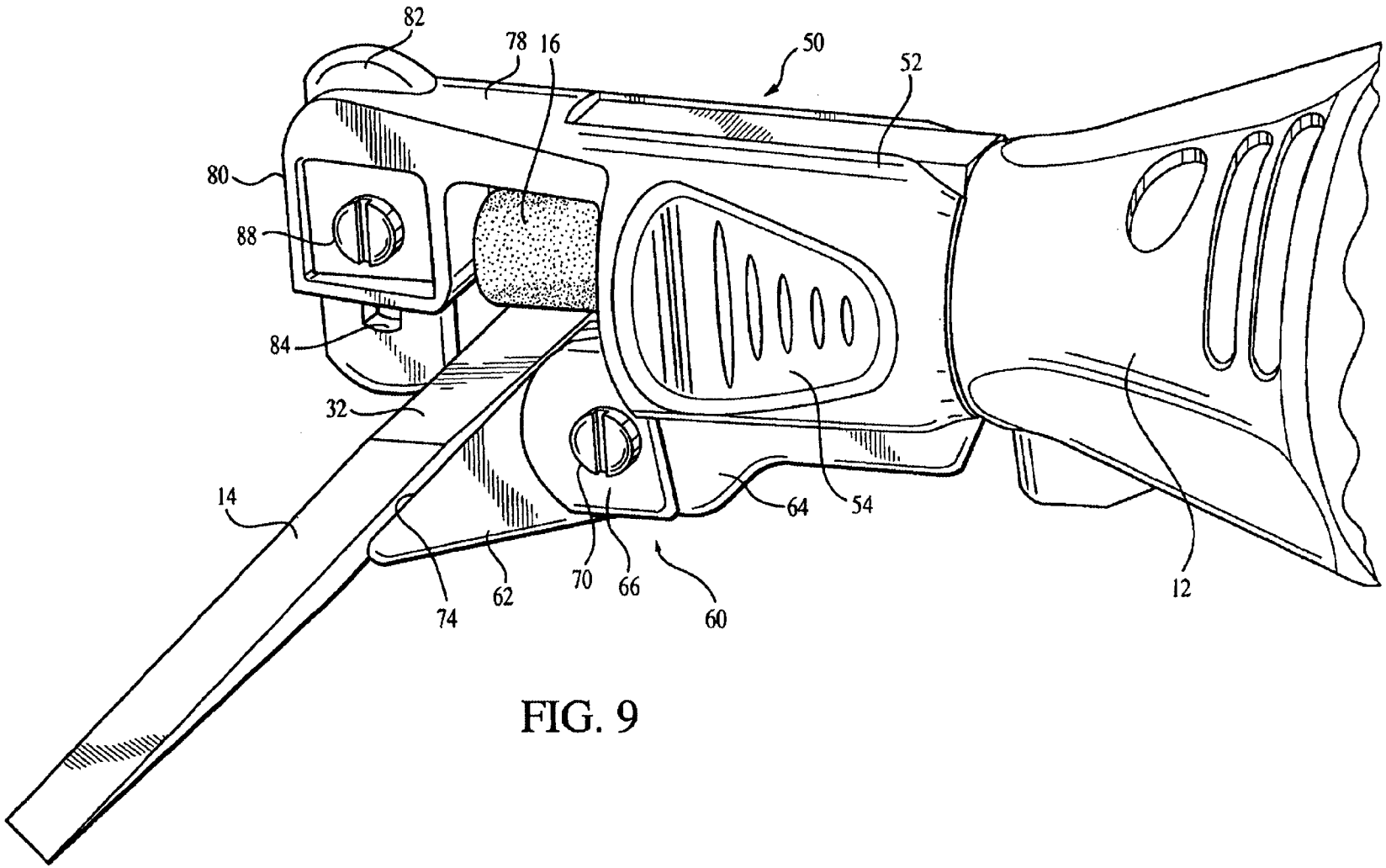
FIG. 9 is a left side perspective view of a second embodiment of the present invention and shown attached to a rotary hand tool and illustrating a blade inserted in the attachment to be sharpened by a cylindrical grinding bit.
Figure 10:
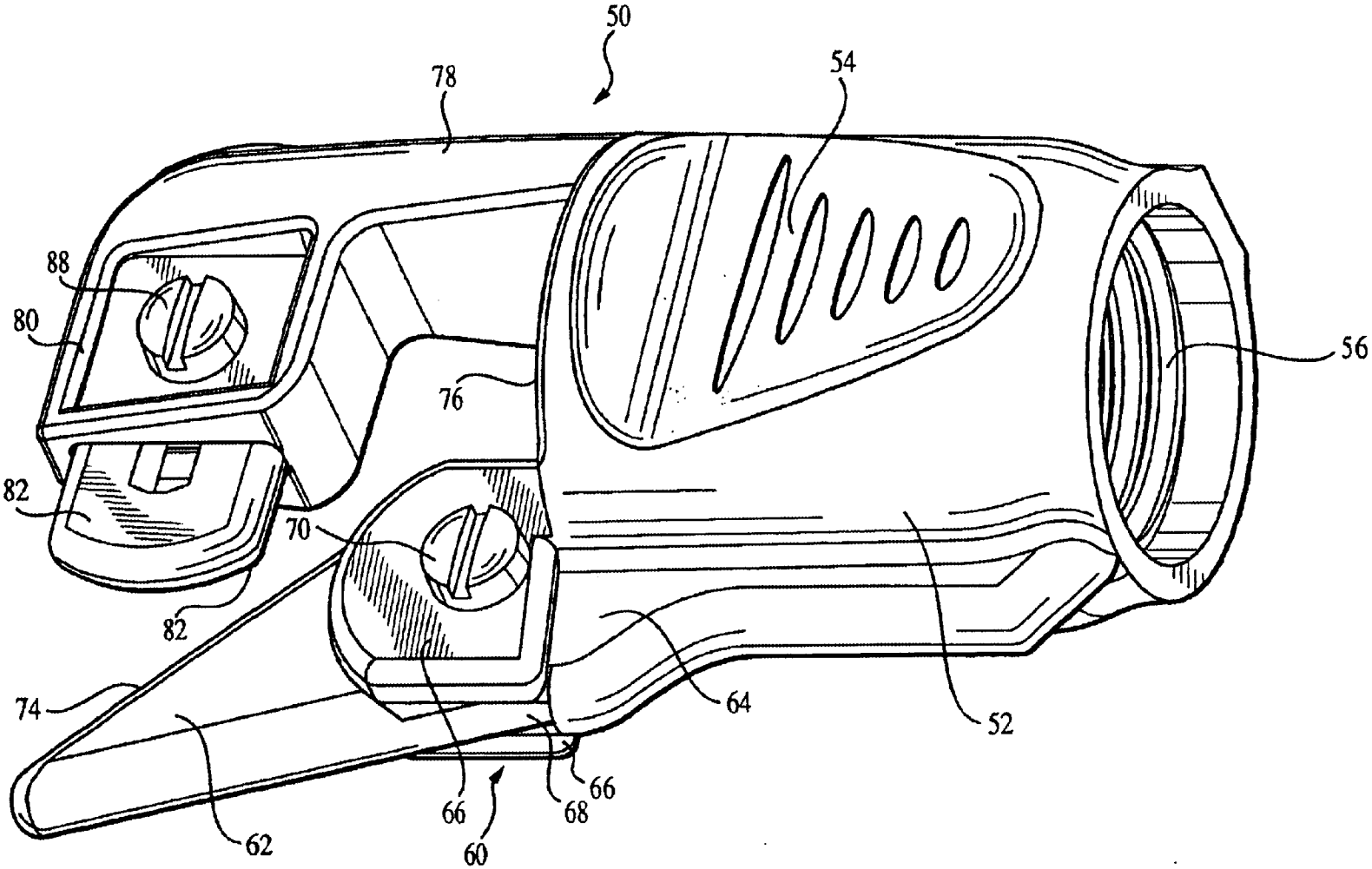
FIG. 10 is a left side/bottom perspective view of the embodiment shown in FIG. 9.

A second embodiment of the present invention is indicated generally at 50 in FIG. 9 and is shown attached to a rotary hand tool 12 and is also shown with a grinding bit 16 attached to the rotary hand tool 12 and with a blade 14 positioned in the attachment to be sharpened. This embodiment has many similarities to the embodiment shown in FIGS. 1–8, but has the advantage of being adjustable so that the angle of an edge 32 of the blade 14 can be changed within a significant range. In the embodiment shown in FIGS. 9–14 a body portion 52 has external recessed flats 54 and internal threads 56 for engaging the external threads of the nose portion of the rotary tool 12. The body portion 52 has an internal diameter 58 that is preferably larger than the outside diameter of the grinding bit 16 so that the attachment 50 can be removed from the rotary tool 12 with the grinding bit 16 being in place.

The attachment 50 has a jaw portion, indicated generally at 60, but is different than the first embodiment in that it has an adjustable jaw member 62 that is attached to a stationary jaw extension 64 of the body portion 52. The jaw extension 64 has relatively thin parts 66 on opposite sides thereof, with a space between the pieces 66 sandwiching a comparable thin portion 68 of the adjustable jaw member 62. Apertures are provided in the pieces 66 and 68 through which a bolt 70 can pass with a nut 72 being provided on the opposite side for securing the angular position of the jaw member 62. By loosening the nut, the angular position of the jaw member can be adjusted to provide the desired angle of a support surface 74 relative to the grinding bit 16.

Figure 11:
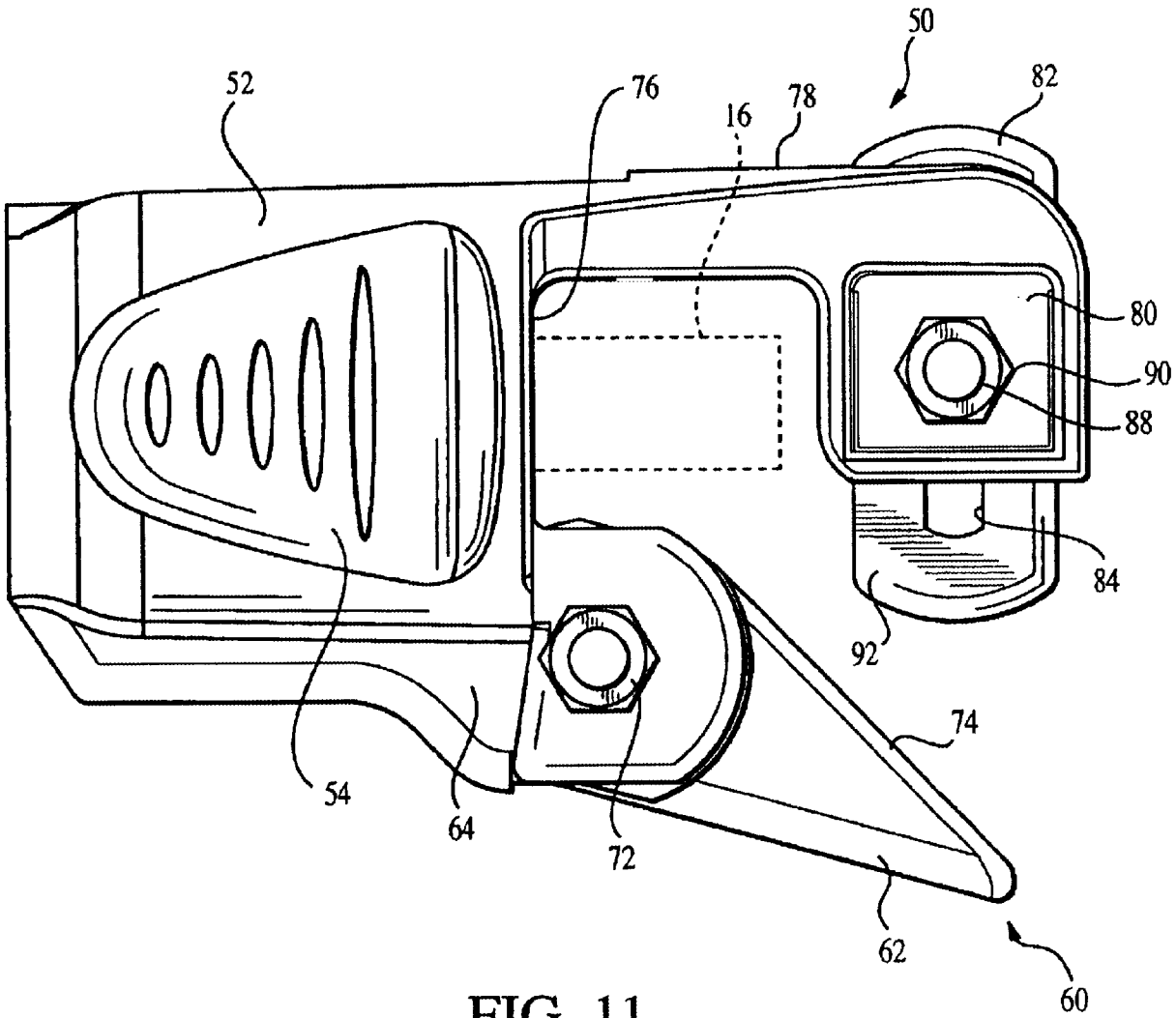
FIG. 11 is a right plan view of the attachment shown in FIG. 9.
Figure 12:
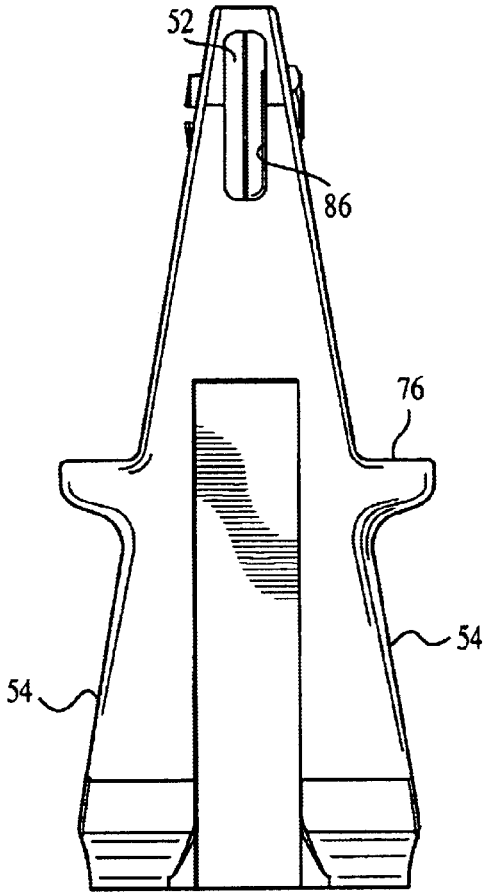
FIG. 12 is a top view of the attachment shown in FIG. 9.
Figure 13:
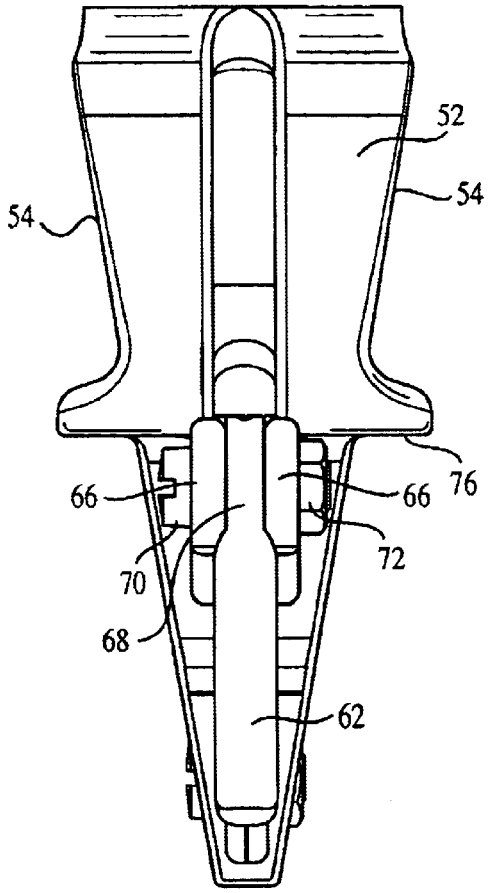
FIG. 13 is a bottom plan view of the attachment shown in FIG. 9.
Figure 14:
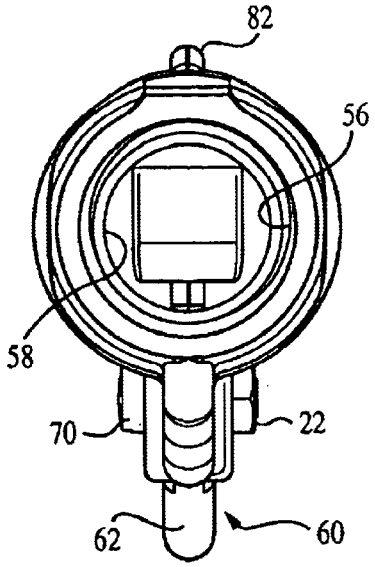
FIG. 14 is a right end view of the attachment shown in FIG. 9.
Figure 15:
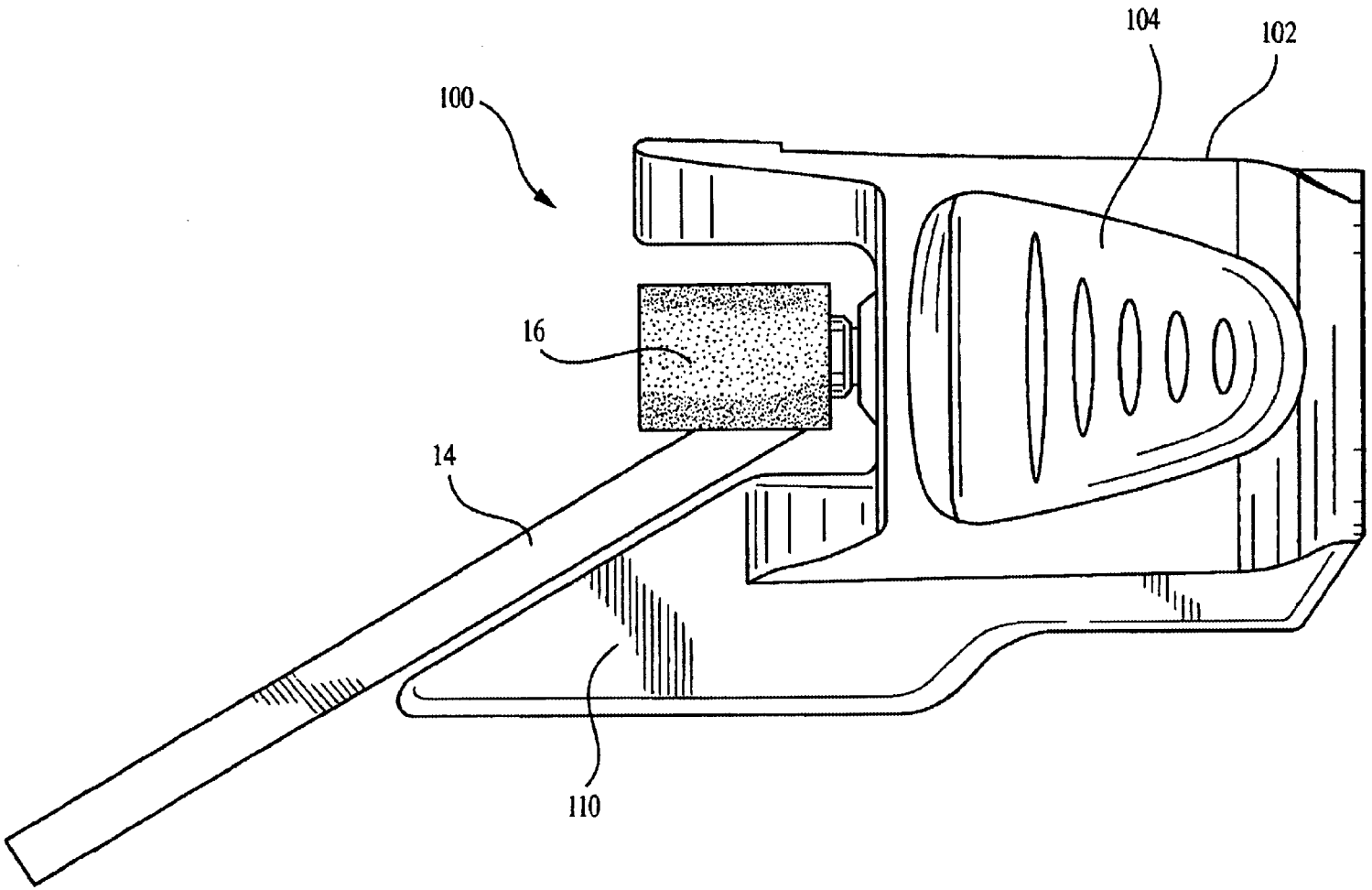
FIG. 15 is a side plan view of a third embodiment of the present invention and is shown attached to a rotary hand tool which has a grinding bit installed therein and with a blade in position for sharpening.
Figure 16:
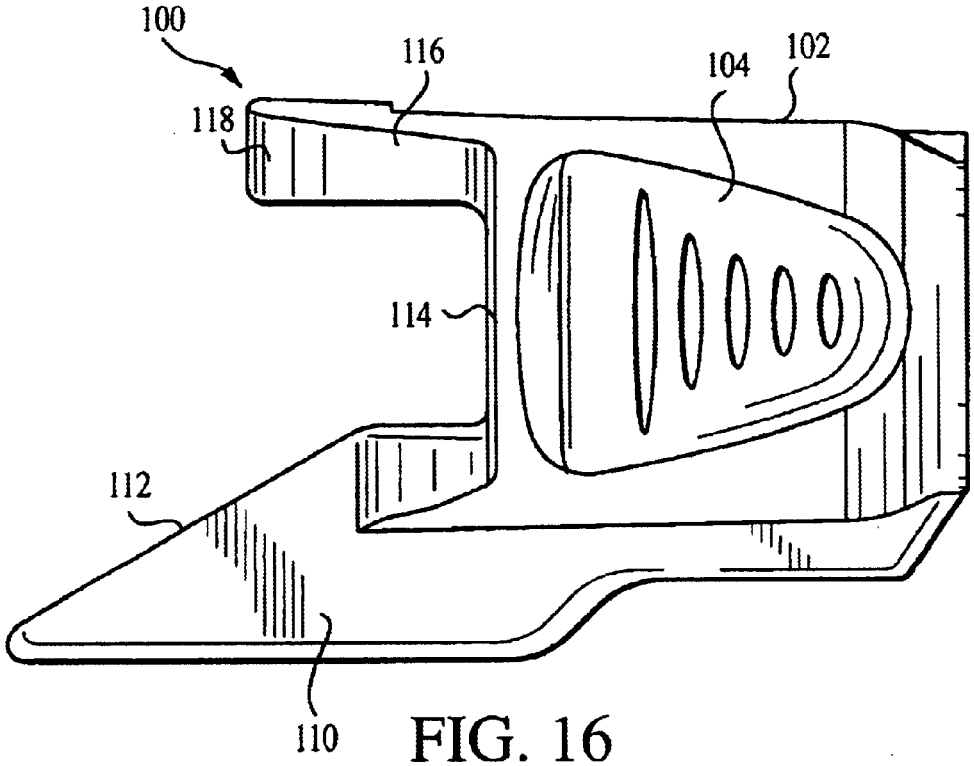
FIG. 16 is a left plan view of the embodiment shown in FIG. 15.

As with the first embodiment, the plane in which the support surface 74 lies intersects the circumference of the grinding bit 16 to assure that the entire surface 32 of the blade 14 that is being sharpened is in contact with the grinding bit 16. The outer end of the body portion has a flat surface or end 76 and an extension 78 is provided which extends beyond the end of the grinding bit 16 as best shown in FIG. 11. The extension also has a transverse end portion 80 in which a slidable member 82 is located, with the slidable member 82 having an elongated slot 84. The member 82 is movable in an opening 86 best shown in FIG. 12. A bolt 88 fits within an aperture in each side of the transverse end portion 80 as well as the elongated slot 84 and a nut 90 is provided on the opposite side thereof. By loosening the nut 90, the slidable member 82 can be moved vertically relative to the transverse end portion 80 so that the bottom edge 92 can be adjusted relative to the support surface 74 to accommodate different thicknesses of blades or tools such as the blade 14.

Figure 17:
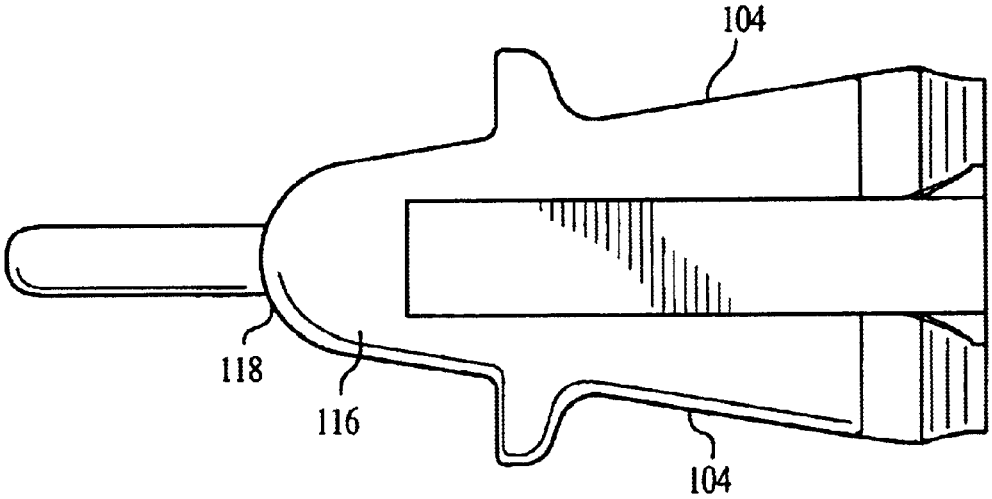
FIG. 17 is a top plan view of the embodiment shown in FIG. 15.
Figure 18:
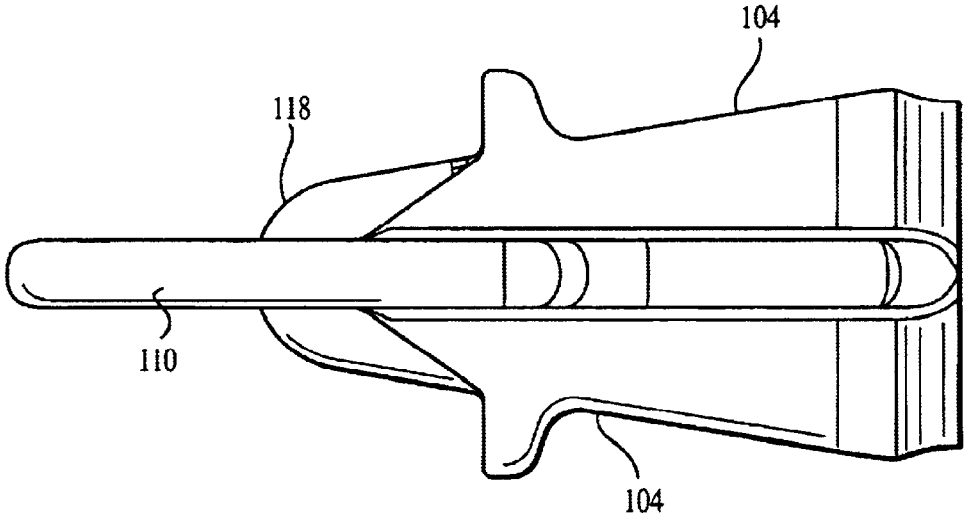
FIG. 18 is a bottom plan view of the embodiment shown in FIG. 15.
Figure 19:
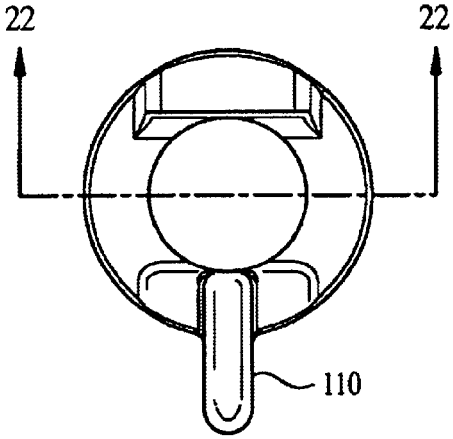
FIG. 19 is a right end view of the embodiment shown in FIG. 15.
Figure 20:
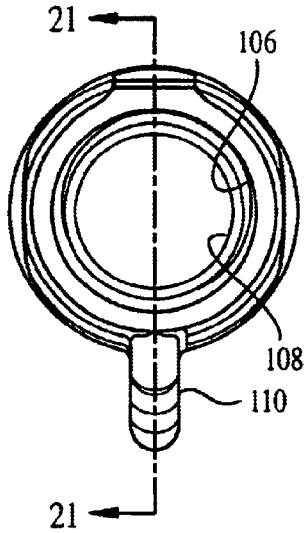
FIG. 20 is a left end view of the embodiment shown in FIG. 15.
Figure 21:
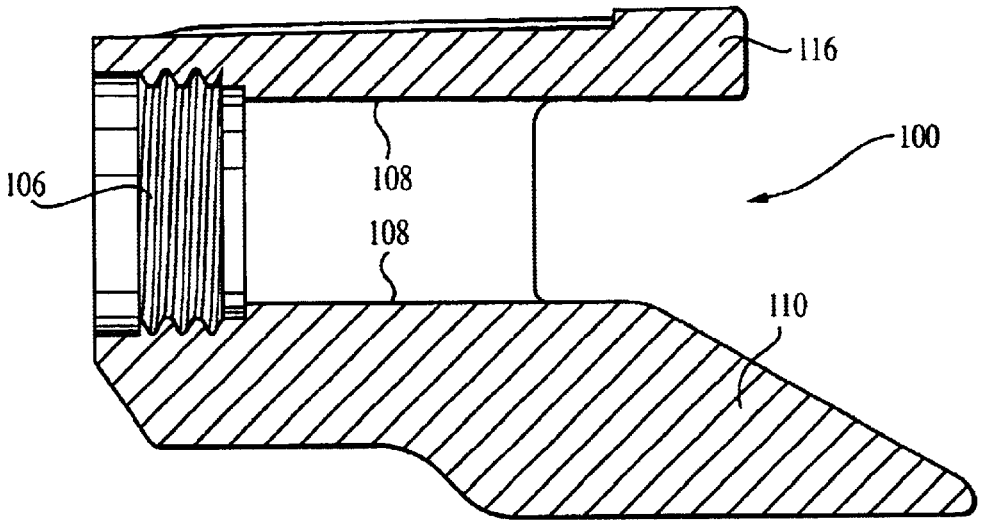
FIG. 21 is a cross section taken along the line 21—21 in FIG. 20.
Figure 22:
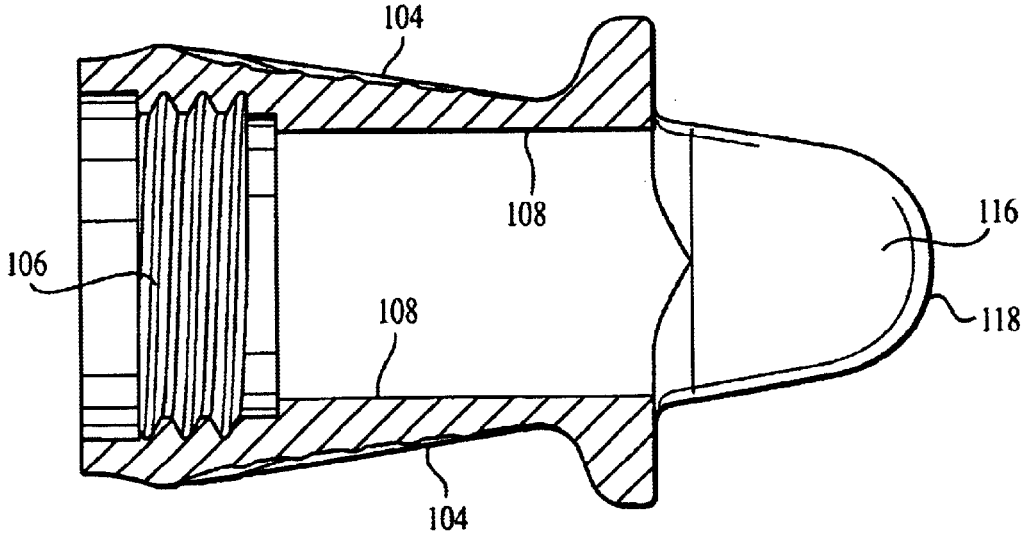
FIG. 22 is a cross section taken along the line 22—22 in FIG. 19.

Turning now to a third embodiment shown in FIGS. 15–22, and indicated generally at 100, it has a body portion 102 with recessed flats 104, an interior threaded portion 106 with the opening 108 having an internal diameter that is greater than that of the grinding bit 16. A jaw portion 110 is provided that is substantially similar to the jaw portion 26 of the first embodiment, it having a support surface 112 that is fixed at a predetermined angle that is preferably within the range of about 15° to about 45°. The body portion extends to the surface 114. The embodiment shown in FIGS. 15–22 also has an extension 116, but it is relatively flat and extends only approximately to the end of the grinding bit 16 as best shown in FIG. 17. The extension 116 is relatively flat and has a generally semicircular configuration 118 as shown from the top thereof.

Figure 23:
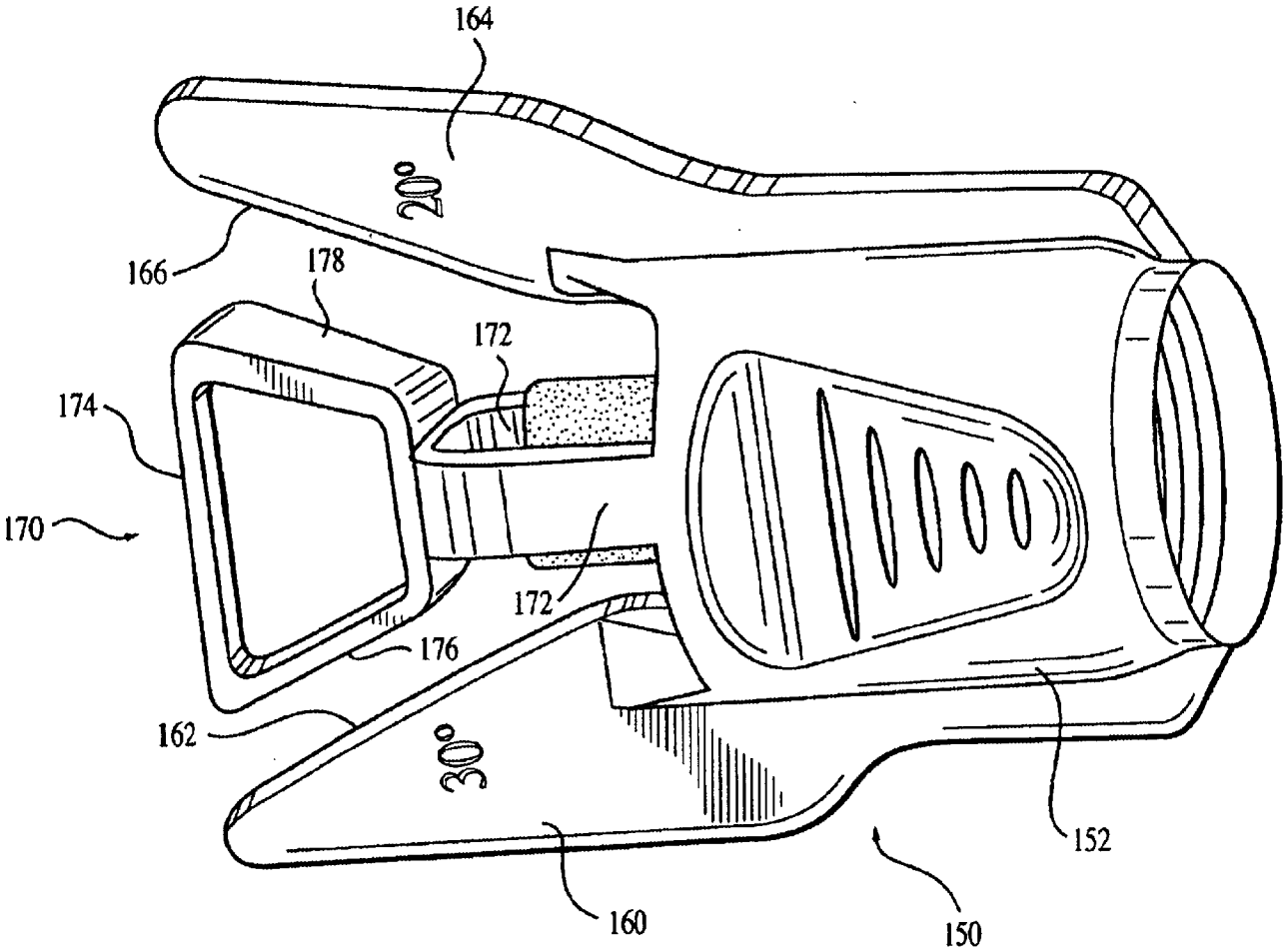
FIG. 23 is a perspective view of a fourth embodiment of the present invention; and, FIG. 24 is a front elevation of the embodiment shown in FIG. 23.
Figure 24:
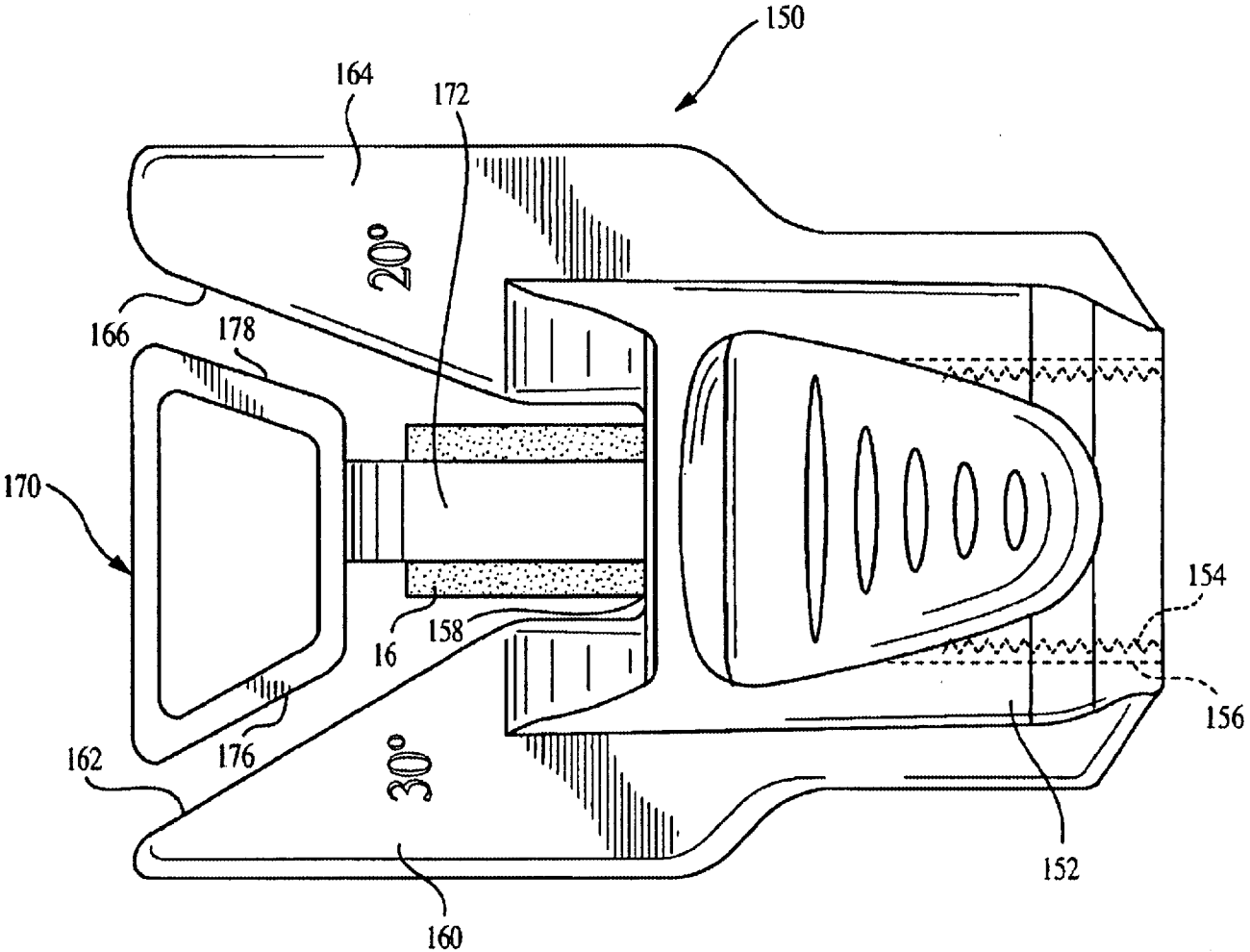
Figure 25:
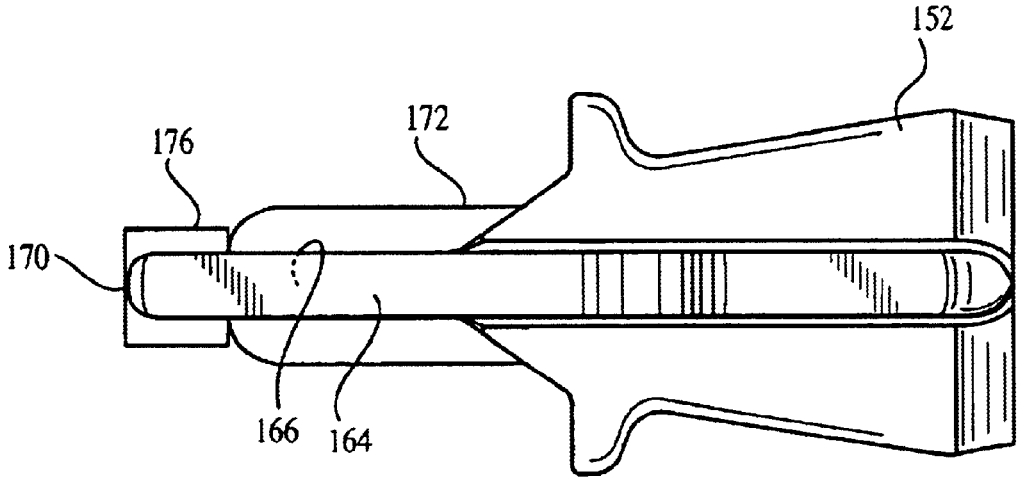
FIG. 25 is a bottom plan view of the embodiment shown in FIG. 24.
Figure 26:
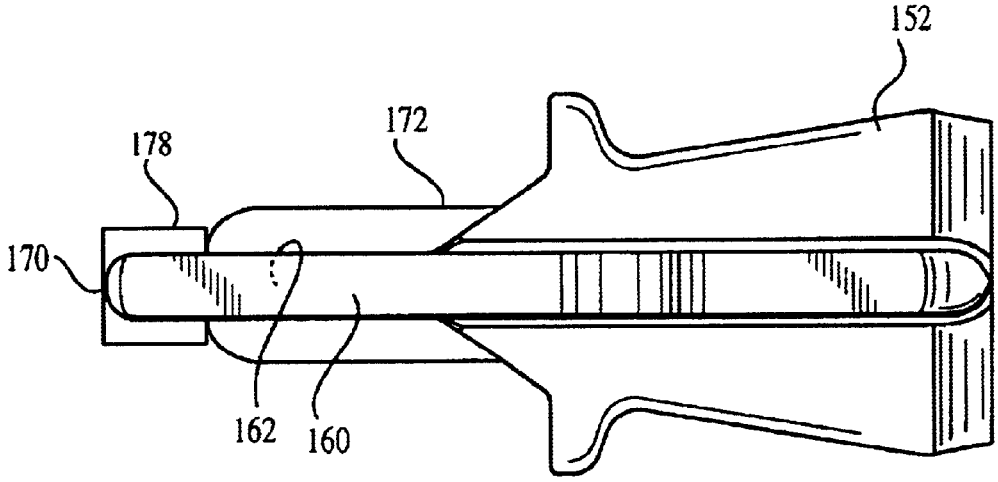
FIG. 26 is a top plan view of the embodiment shown in FIG. 24.
Figure 27:
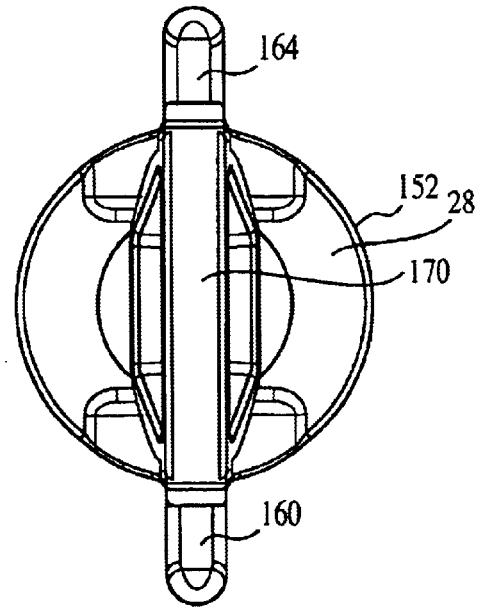
FIG. 27 is a left end view of the embodiment shown in FIG. 24.
Figure 28:
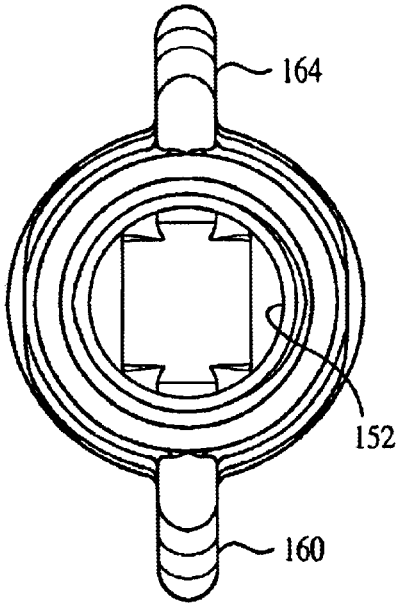
FIG. 28 is a right end view of the embodiment shown in FIG. 24.
Figure 29:
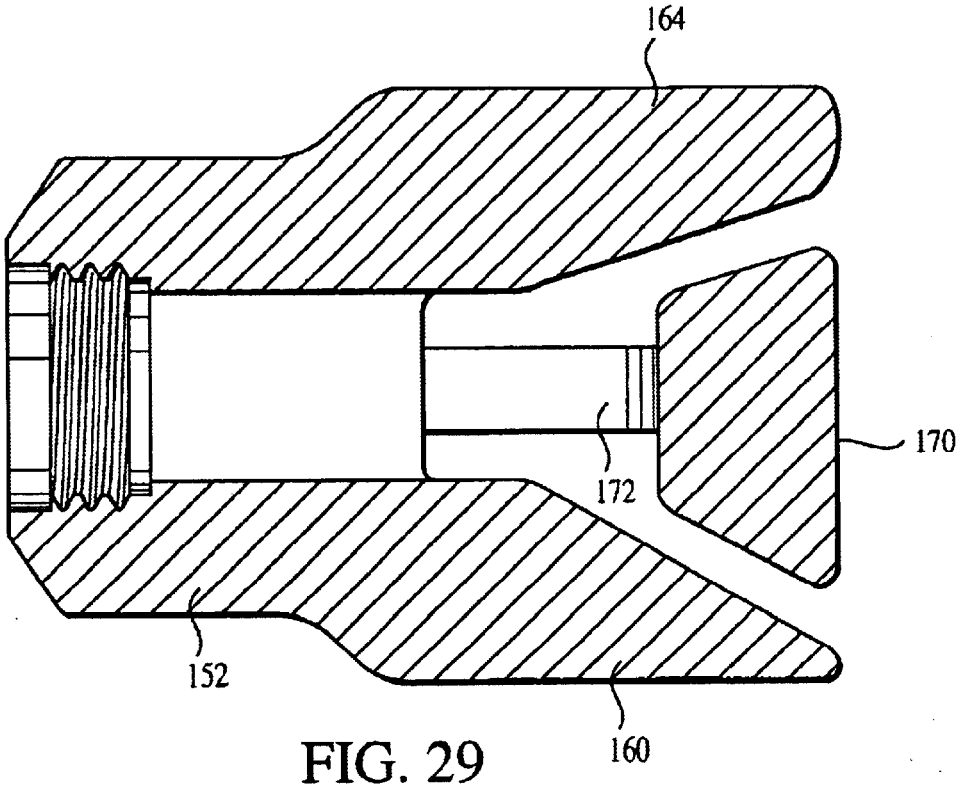
FIG. 29 is a cross section taken along a vertical plane generally through the center of the embodiment shown in FIG. 24.
Figure 30:
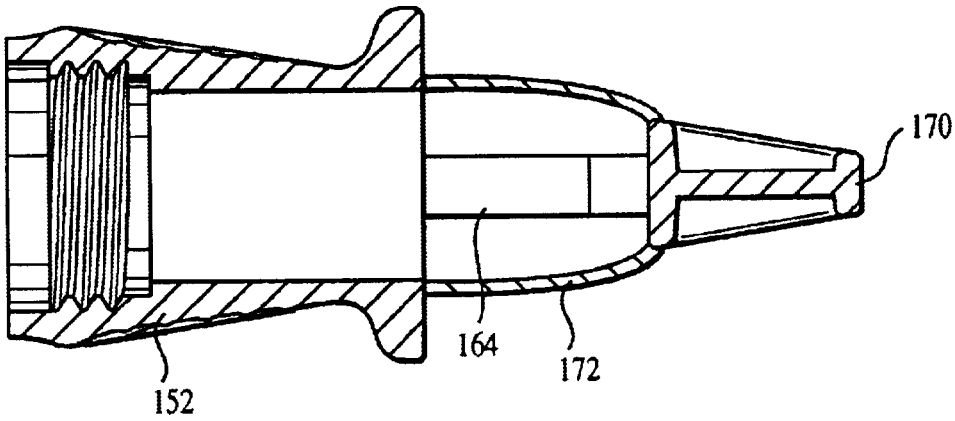
FIG. 30 is a cross section taken along a horizontal plane generally through the center of the embodiment shown in FIG. 24.

Turning now to a fourth embodiment as shown in FIGS. 23 and 24, an attachment indicated generally at 150 is provided which includes a body portion 152 having internal threads 154 and an opening 156 which is larger than the diameter of the grinding bit 16. The body portion 152 of this embodiment extends to a surface 158. A first jaw portion 160 is provided which has a support surface 162 with a predetermined acute angle relative to the access of the bit 16. A second jaw portion 164 is provided on the opposite side of the attachment 150 and it has a support surface 166 that is also at an acute angle relative to the grinding bit 16. As shown in the drawing, the angle of the support surface 162 is shown to be 30° while the angle of the support surface 166 is shown to be approximately 20°. It should be appreciated that the two support surfaces may have predetermined angles that are each within the range of about 15° to about 45°, it is desirable that the two support surfaces have different predetermined angles to enable a blade or tool to be sharpened with different angled cutting surfaces, if desired.

This embodiment has an extension, indicated generally at 170, attached to said body portion and extending forwardly thereof and located between the first jaw portion 160 and the second jaw portion 164, with the extension 170 comprising side portions 172 located on opposite sides of the sharpening bit 16 and extending beyond the end of the sharpening bit and having a bridging portion 174 connecting said side portions 172 together. The bridging portion 174 has outer gap guide surfaces 176, 178 for contacting tool member (not shown). The gap guide surfaces 176, 178 preferably lie in respective planes that are at an acute angle relative to the axis of the sharpening bit, intercept the surface of the grinding bit 15 and are preferably parallel to the planes of the respective support surfaces 162 and 166.

From the foregoing, it should be appreciated that an improved sharpening attachment for a rotary hand tool that is effective and convenient in its use, in that it is extremely portable and yet is capable of sharpening tools, blades and the like in a manner that results in a constant sharpening angle. The design of the attachment enables it to be easily attached and removed without special tools and also contributes to its safety during use.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the present invention are set forth in the following claims.

What is claimed is:

1. A sharpening attachment for a rotary hand tool having an output shaft with a tool bit holder and a housing with a nose portion including an opening in which the output shaft is located, and a sharpening bit mounted in the tool bit holder for engaging a work surface, said attachment comprising:

a body portion having a rear end for mounting to the housing of the hand tool, said body portion having an internal opening aligned with the output shaft and sized to receive and permit rotation of the tool bit holder and a generally cylindrical sharpening bit, with at least a portion of the sharpening bit being exposed forwardly of said rear end for engagement with a tool member to be sharpened;

a jaw portion attached to said body portion and extending forwardly along one side thereof and having a support surface for holding the tool member relative to the sharpening bit, said surface lying in a plane at an acute angle relative to the sharpening bit;

an extension attached to said body portion and extending forwardly thereof to a point that is coextensive with at least a major portion of the exposed portion of the sharpening bit to thereby define a protective guard;

said extension being on the side opposite said jaw portion, said extension extending beyond the end of the sharpening bit and having a transverse end portion that extends to the opposite side thereof, said end portion having a gap guide surface for contacting the tool member.

2. A sharpening attachment as defined in claim 1 wherein said nose portion has threads adapted to engage the attachment, the interior of said body portion having interior threads for engaging the nose threads.

3. A sharpening attachment as defined in claim 2 wherein said body portion has generally flat surfaces on opposite sides thereof for facilitating a user turning the body portion to attach or remove said attachment.

4. A sharpening attachment as defined in claim 1 wherein said body portion, said jaw portion and said extension are integrally formed of a plastic or plastic-like material.

5. A sharpening attachment as defined in claim 1 wherein the sharpening bit is generally cylindrically shaped, said internal opening of said body portion being slightly larger than the sharpening bit so that said attachment can be mounted on the rotary hand tool while the sharpening bit is attached in the tool bit holder.

6. A sharpening attachment as defined in claim 1 wherein said gap guide surface is in a plane that is at an acute angle relative to the axis of the sharpening bit, with the plane also intersecting the outer circumference of the sharpening bit.

7. A sharpening attachment as defined in claim 6 wherein said plane of said gap guide surface is substantially parallel to the plane of said support surface, the distance between said planes being predetermined and defining the maximum thickness of the tool member.

8. A sharpening attachment as defined in claim 1 wherein said jaw portion is pivotally attached to said body portion so that the support surface lying in a plane that is at an adjustable acute angle relative to the axis of the sharpening bit so that tool members can be sharpened to different angles by the sharpening bit.

9. A sharpening attachment as defined in claim 8 wherein said extension extends beyond the end of the sharpening bit and has transverse end portion that is adjustable in the radial direction toward the opposite side thereof, said end portion having a gap guide surface for contacting the tool member.

10. A sharpening attachment as defined in claim 9 wherein said gap guide surface of said transverse end portion can be moved relative to the plane of said support surface, the distance between said surface and said plane being adjustable to the thickness of the tool member.

11. A sharpening attachment as defined in claim 10 wherein said transverse end portion is secured to said extension by a nut and bolt, with the transverse end portion having an elongated slot in which said bolt is located, the transverse end portion being slidable relative to said bolt to vary the distance between gap guide surface and said support surface.

12. A sharpening attachment as defined in claim 1 wherein said extension is generally flat.

13. A sharpening attachment as defined in claim 12 wherein said extension has a width that is wider than the sharpening bit and has a generally semicircular end configuration.

14. A sharpening attachment as defined in claim 1 further comprising a second jaw portion located generally on the side of said body portion opposite said jaw portion, said second jaw portion extending forwardly along one side thereof and having a second support surface for holding the tool member relative to the sharpening bit.

15. A sharpening attachment as defined in claim 14 wherein the sharpening bit is generally cylindrically shaped, said support surface lying in a plane that is at an acute first predetermined angle relative to the axis of the sharpening bit, said plane intersecting the outer circumference of the sharpening bit, said second support surface lying in a plane that is at an acute predetermined angle relative to the axis of the sharpening bit, said plane intersecting the outer circumference of the sharpening bit.

16. A sharpening attachment as defined in claim 15 wherein said first predetermined angle is different from said second predetermine angle.

17. A sharpening attachment as defined in claim 15 wherein said extension is located between said jaw portion and said second jaw portion and comprises side portions located on opposite sides of the sharpening bit, said extension extending beyond the end of the sharpening bit and having a bridging portion connecting said side portions together, each of the outer surfaces of said bridging portion lying in respective planes that are at an acute angle relative to the axis of the sharpening bit.

18. A sharpening attachment as defined in claim 17 wherein the plane of each of said outer surfaces of said bridging portion intersects the outer circumference of the sharpening bit.

19. A sharpening attachment for a rotary hand tool having an output shaft with a tool bit holder and a housing with a nose portion including an opening in which the output shaft is located, and a generally cylindrically shape sharpening bit mounted in the tool bit holder for engaging a work surface, said attachment comprising:

a body portion having a rear end for mounting to the housing of the hand tool, said body portion having an internal opening aligned with the output shaft and sized to receive and permit rotation of the tool bit holder and sharpening bit, with at least a portion of the sharpening bit being exposed forwardly of said rear end for engagement with a tool member to be sharpened;

a jaw portion attached to said body portion and extending forwardly along one side thereof and having a support surface for holding the tool member relative to the sharpening bit, said support surface lying in a plane that is at an acute angle relative to the axis of the sharpening bit, said plane intersecting the outer circumference of the sharpening bit;

an extension attached to said body portion and extending forwardly thereof to a point that is coextensive with at least a major portion of the exposed portion of the sharpening bit to thereby define a protective guard, said extension being on the side opposite said jaw portion and extending beyond the end of the sharpening bit and having a transverse end portion that extends to the opposite side thereof, said end portion having a gap guide surface for contacting the tool member.

20. A sharpening attachment for a rotary hand tool having an output shaft with a tool bit holder and a housing with a nose portion including an opening in which the output shaft is located, and a sharpening bit mounted in tool bit holder for engaging a work surface, said attachment comprising:

a body portion having a rear end for mounting to the housing of the hand tool, said body portion having an internal opening aligned with the output shaft and sized to receive and permit rotation of the tool bit holder and sharpening bit, with at least a portion of the sharpening bit being exposed forwardly of said rear end for engagement with a tool member to be sharpened;

a jaw portion attached to said body portion and extending forwardly along one side thereof and having a support surface for holding the tool member relative to the sharpening bit, said jaw portion being pivotally attached to said body portion so that the support surface is in a plane that is at an adjustable acute angle relative the axis of the sharpening bit so that tool members can be sharpened to different angles by the sharpening bit;

an extension attached to said body portion and extending forwardly thereof to a point that is coextensive with at least a major portion of the exposed portion of the sharpening bit to thereby define a protective guard, said extension extending beyond the end of the sharpening bit and having a transverse end portion that is adjustable in the radial direction toward the opposite side thereof, said end portion having a gap guide surface for contacting a tool member.

21. A sharpening attachment for a rotary hand tool having an output shaft with a tool bit holder and a housing with a nose portion including an opening in which the output shaft is located, and a sharpening bit mounted in the tool bit holder for engaging a work surface, said attachment comprising:

a body portion having a rear end for mounting to the housing of the hand tool, said body portion having an internal opening aligned with the output shaft and sized to receive and permit rotation of the tool bit holder and sharpening bit with at least a portion of the sharpening bit being exposed forwardly of said rear end for engagement with a tool member to be sharpened;

a jaw portion attached to said body portion and extending forwardly along one side thereof and having a support surface for holding the tool member relative to the sharpening bit;

a generally flat extension attached to said body portion and extending forwardly thereof to a point that is approximately at the outer end of the sharpening bit to thereby define a protective guard.

22. A sharpening attachment for a rotary hand tool having an output shaft with a tool bit holder and a housing with a nose portion including an opening in which the output shaft is located, and a generally cylindrically shaped sharpening bit mounted in the tool bit holder for engaging a work surface, said attachment comprising:

a body portion having a rear end for mounting to the housing of the hand tool, said body portion having an internal opening aligned with the output shaft and sized to receive and permit rotation of the tool bit holder and sharpening bit with at least a portion of the sharpening bit being exposed forwardly of said rear end for engagement with a tool member to be sharpened;

a first jaw portion attached to said body portion and extending forwardly along one side thereof and having a first support surface for holding the tool member relative to the sharpening bit;

a second jaw portion located generally on the side of said body portion opposite said first jaw portion, said second jaw portion extending forwardly along one side thereof and having a second support surface for holding the tool member relative to the sharpening bit;

an extension attached to said body portion and extending forwardly thereof and located between said first jaw portion and said second jaw portion, said extension comprising side portions located on opposite sides of the sharpening bit, said extension extending beyond the end of the sharpening bit and having a bridging portion connecting said side portions together, each of the outer surfaces of said bridging portion lying in respective planes that are at an acute angle relative to the axis of the sharpening bit.

23. A sharpening attachment as defined in claim 22 wherein said first support surface lies in a first plane that is at an acute first predetermined angle relative to the axis of the sharpening bit, said first plane intersecting the outer circumference of the sharpening bit, said second support surface lying in a second plane that is at an acute predetermined angle relative to the axis of the sharpening bit, said second plane intersecting the outer circumference of the sharpening bit.

24. A sharpening attachment as defined in claim 22 wherein the plane of each of said outer surfaces of said bridging portion intersects the outer circumference of the sharpening bit.

* * * * *

UNITED STATES PATENT AND TRADEMARK OFFICE

CERTIFICATE OF CORRECTION

PATENT NO. : 6,846,231 B2
DATED : January 25, 2005
INVENTOR(S) : Oles et al.

It is certified that error appears in the above-identified patent and that said Letters Patent is hereby corrected as shown below:

Column 7,
Line 42, delete "shape" and insert -- shaped --.

Column 8,
Line 18, after "relative" insert -- to --.

Signed and Sealed this

Twelfth Day of July, 2005

JON W. DUDAS
*Director of the United States Patent and Trademark Office*